US005597099A

United States Patent [19]

Sharp

[11] Patent Number: 5,597,099

[45] Date of Patent: Jan. 28, 1997

[54] GARMENT WAISTBAND STRETCHER

[76] Inventor: Shirley Sharp, 904 N. 2nd St., Amite, La. 70422

[21] Appl. No.: 556,381

[22] Filed: Nov. 13, 1995

[51] Int. Cl.[6] ..... D06C 15/00; D06C 3/08

[52] U.S. Cl. ..... 223/61; 223/63; 223/69; 38/102.6; 38/102.8

[58] Field of Search ..... 223/61, 63, 52, 223/69, 95; 33/2 R, 811, 812, 810; 38/70, 102, 102.1, 102.6, 102.8

[56] References Cited

U.S. PATENT DOCUMENTS

| | | | |
|---|---|---|---|
| 437,390 | 9/1890 | Wyman | 223/95 |
| 761,803 | 7/1904 | Wickelberg | 223/61 |
| 2,122,432 | 7/1938 | Maschke | 223/69 |
| 2,393,632 | 1/1946 | Hartz | 223/95 |
| 2,835,421 | 5/1958 | Marchese | 223/61 |
| 2,943,773 | 7/1960 | Bahnik | 223/63 |
| 2,954,150 | 9/1960 | Pace | 223/95 |
| 3,559,852 | 2/1971 | Green | 223/96 |
| 4,593,839 | 6/1986 | Vandoros | 223/63 |
| 4,746,040 | 5/1988 | Hazenveld | 223/96 |
| 5,022,571 | 6/1991 | Blanchard | 223/95 |
| 5,236,109 | 8/1993 | Zuckerman | 223/95 |
| 5,263,617 | 7/1993 | Martin | 223/63 |

*Primary Examiner*—Bibhu Mohanty
*Attorney, Agent, or Firm*—Joseph N. Breaux

[57] ABSTRACT

A garment waistband stretcher including a pair of identical, elongated stretching arms that are interlockable with a pivot pin and lockable in a stretching configuration with a locking pin. Each stretching arm is of a length about one-quarter (¼") inch shorter than twice the smallest size waistband with which the stretcher is to be utilized and includes a plurality of pin receiving apertures spaced along the length thereof. A waistband clip is secured to one end of the stretcher arm for securing the waistband of a garment to be stretched. Each stretcher arm also preferably includes a finger loop at a second end of the stretcher arm opposite the waistband clip.

4 Claims, 4 Drawing Sheets

GARMENT WAISTBAND STRETCHER

TECHNICAL FIELD

The present invention relates to devices used to stretch the waistband of a garment and more particularly to devices used to stretch the waistband of a garment that may be arranged by a user in a manner to stretch waistbands of various sizes and that include a pair of interlinkable stretching bars that are pivotally interlinked at a user selected pivot point.

BACKGROUND ART

Shrinkage of garments caused by laundering and/or increased waist size of a wearer often require increasing the size of the garment waistband before the garment may be worn. One way to increase the size of the waistband is to partially disassemble the garment and restitch the disassembled pieces to form a larger waistband. This method is preferred when large waistband size adjustments are required.

When smaller adjustments are required or adjustments to garments made from materials such as cotton that expand after several hours of wear, such as jeans, it is often desirable to mechanically stretch the waistband fabric. Although mechanically stretching the waistband provides excellent results in some cases, it is often difficult for individual to apply enough force to stretch the waistband to the desired size. It would be desirable, therefore, to have a device securable to the waistband of a garment that could be utilized to stretch the waistband of the garment. Because the use of mechanical stretching devices can cause damage to the garment by overstretching the garment, it would be a further benefit if the device included a mechanism for preventing stretching of the garment waistband past a predetermined size. Because a quantity of the devices may be required when laundering a quantity of jeans etc., it would be a still further benefit if the device was inexpensive and easy to manufacture and use.

GENERAL SUMMARY DISCUSSION OF INVENTION

It is thus an object of the invention to provide a garment waistband stretcher that is securable to the waistband of a garment that could be utilized to stretch the waistband of the garment.

It is a further object of the invention to provide a garment waistband stretcher that includes a mechanism for preventing stretching of the garment waistband past a predetermined size.

It is a still further object of the invention to provide a garment waistband stretcher that is inexpensive and easy to manufacture and use.

It is a still further object of the invention to provide a garment waistband stretcher that satisfies all or some of the aforementioned objects in combination.

Accordingly, a garment waistband stretcher is provided. The garment waistband stretcher includes a pair of identical, elongated stretching arms that are interlockable with a pivot pin assembly and lockable in a stretching configuration with a locking pin. Each stretching arm is of a length about one-quarter (¼") inch shorter than twice the smallest size waistband with which the stretcher is to be utilized and includes a plurality of pin receiving apertures spaced along the length thereof. A waistband clip is secured to one end of the stretcher arm for securing the waistband of a garment to be stretched. Each stretcher arm also preferably includes a finger loop at a second end of the stretcher arm opposite the waistband clip.

The pin apertures are sized to receive the pivot pin and the locking pin. A plurality of the pin apertures beginning with a pin aperture located midway along the stretcher arm centrally located aperture include adjacently positioned indicia indicating various waistband sizes.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
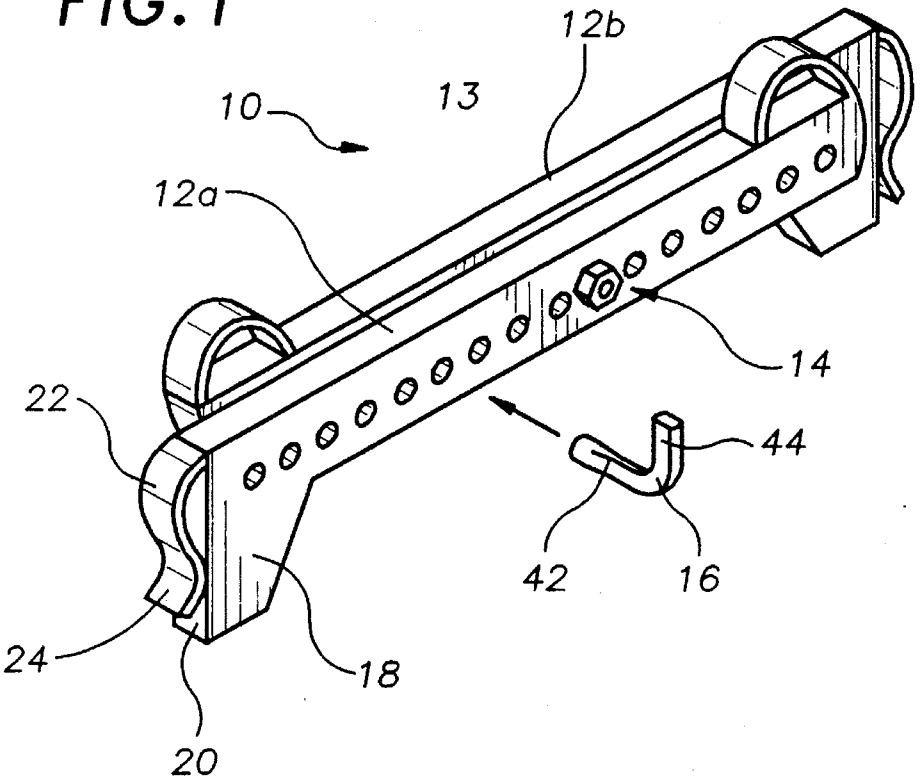
FIG. 1 is a perspective view of an exemplary embodiment of the waistband garment stretcher of the present invention with the pivot pin assembly installed within a pin a aperture and the locking pin exploded away from the figure and directed toward a pin aperture.

FIG. 1 shows an exemplary embodiment of the waistband garment stretcher of the present invention generally referenced by the numeral 10. Waistband stretcher 10 includes a pair of identical, elongated stretching arms **12*a*, 12*b*, a pivot pin assembly, generally referenced by the numeral 14, and a locking pin 16. In this embodiment, each stretching arm 12*a*, 12*b* is constructed of wood, is about fifteen inches long and includes an expanded waistband engaging end 18 having a waistband contact surface 20 that is oriented at about a ninety degree angle with respect to the longitudinal axis of stretcher arm 12*a*, 12*b*. Each waistband contact surface 20 has a resilient waistband clip 22 secured adjacent thereto having a distal end 24 curved away from waistband contact surface 20 to aid insertion of a garment waistband between waistband clip 22 and waistband contact surface 20**.

Figure 1A:
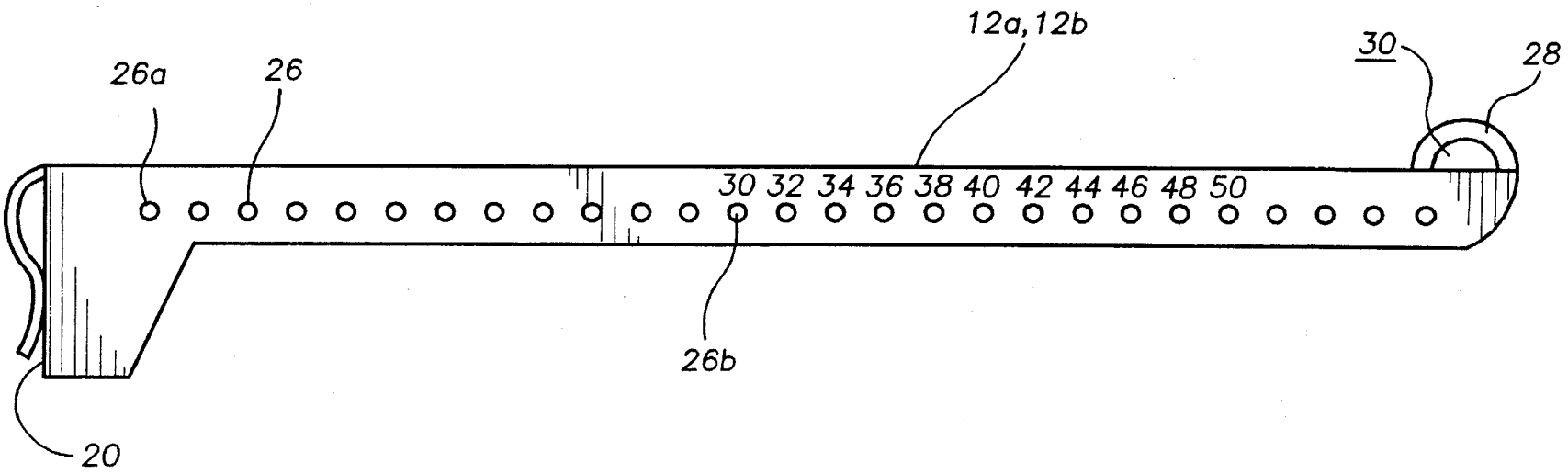
FIG. 1A is a side view of one of the identical stretcher arms of the exemplary embodiment shown in FIG. 1 showing the spaced pin apertures, the waistband size indicia adjacent a group of pin apertures, the finger loop member, and the waistband clip.

With reference to FIG. 1A, twenty-seven (27) three-sixteenths (3/16") inch diameter pin apertures 26 are spaced along the length of stretcher arm **12*a*, 12*b* at a distance, between pin aperture centers, of about one-half (7½") inch. A first pin aperture 26*a* is located about one (1") inch from waist band contact surface 20. A second pin aperture 26***b* is located in the middle of stretcher arm 12*a*, 12*b* about seven and one-half (7½") inches from waistband contact surface 20. Each pin aperture 26 beginning with pin aperture 26*b* and moving sequentially away from waistband contact surface 20 has a numeral painted on the surface adjacent thereto beginning with the numeral 30 and increasing by two up to and including the numeral 50.

Figure 1B:
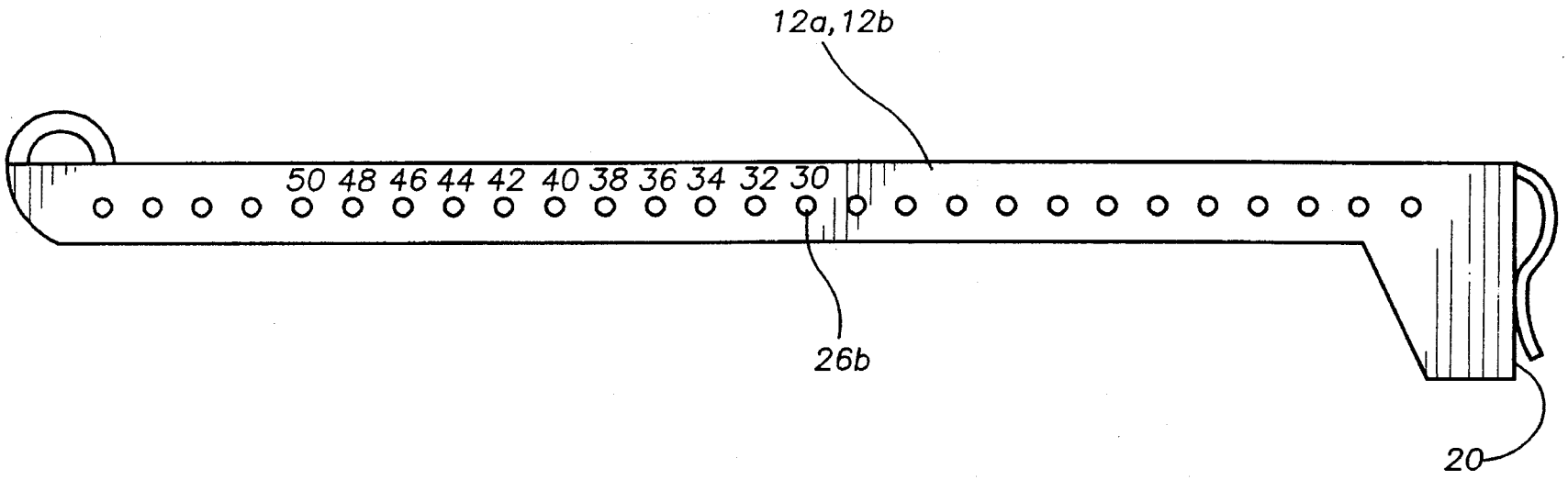
FIG. 1B is a side view of the other side of the stretcher arm shown in FIG. 1A showing the spaced pin apertures, the waistband size indicia adjacent a group of pin apertures, the finger loop member, and the waistband clip.

A finger loop member 28 is provided on each stretcher arm 12*a*, 12*b* at an end opposite waistband contact surface 20. Finger loop member 28 defines a finger aperture 30 sized to allow the finger of a user to be inserted therein. FIG. 1B is a second side view of stretcher am 12*a*, 12*b* showing the numerals thirty (30) through fifty (50), in intervals of two, adjacent pin apertures 26 beginning with pin aperture 26*b* and moving away from waistband contact surface 20 as they appear on the side not shown in FIG. 1A.

Figure 2:
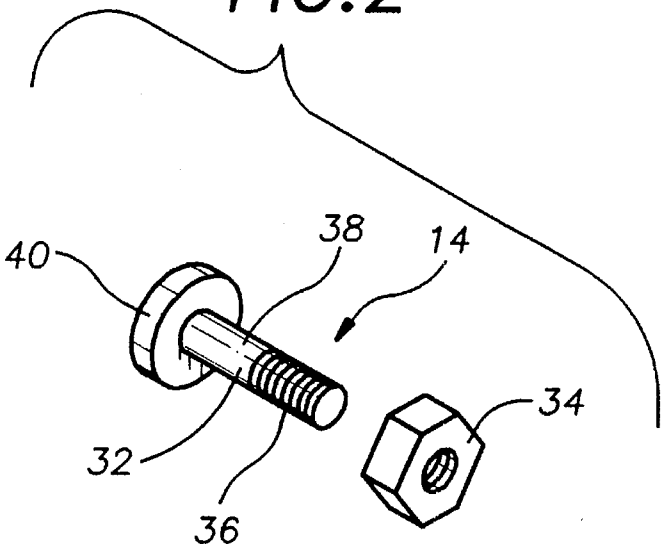
FIG. 2 is an exploded perspective view of the pivot pin assembly including a pivot pin having a terminal threaded end, and a securing nut companionately threaded with the threaded end of the pivot pin.

With reference to FIG. 2, pivot pin assembly 14 includes a pivot pin 32 and a securing nut 34. Pivot pin 32 has a threaded end 36, a shank 38 sized to snugly pass through pin apertures 26, and a shank cap 40 secured to a non-threaded end of shank 38. Securing nut 34 is companionately threaded to engage and secure threaded end 36 after shank 38 has been inserted through a pin aperture 26 of a stretcher arm 12*a* and a pin aperture of a stretcher arm 12*b*. With reference to FIG. 1 locking pin 16 has a locking pin portion 42 that is sized to snugly pass through pin apertures 26 and a grasping portion 44 extending at a right angle from locking pin portion 42.

Figure 3:
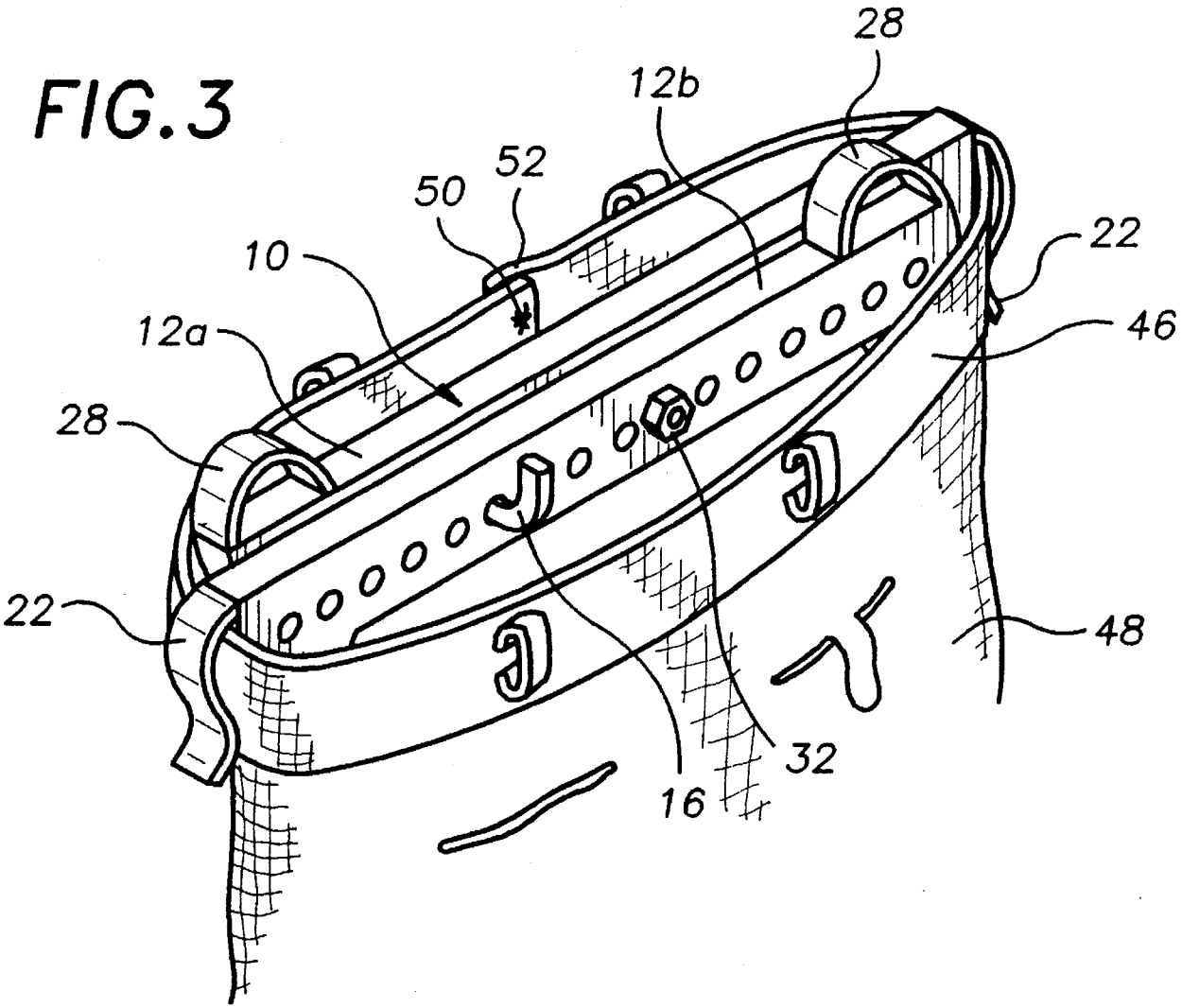
FIG. 3 is a perspective view of the embodiment of the waistband stretcher shown in FIG. 1 in use with a representative garment with the waist band clips secured to the garment waistband, the pivot pin inserted through a desired pin aperture, and the locking pin inserted through another pin aperture prevent the first and second stretcher arms from pivoting with respect to each other.

Use of garment waistband stretcher 10 is now described with general reference to FIGS. 1, 1A, 1B, and 2; and specific reference to FIG. 3. FIG. 3 shows a representative garment 48 of the type with which garment waistband stretcher 10 is utilized. Representative garment 48 includes a waistband 46 that has two ends 50, 52 that are securable to form a closed loop. Garment waistband stretcher 10 is utilized to stretch waistband 46 as follows. The desired waistband size between thirty (30") and fifty (50") inches its determined by the user. Shank 38 of pivot pin 32 is inserted through a first pin aperture 26 through a stretcher arm 12*a* having an numeral adjacent thereto corresponding to the desired waistband size. If the desired waistband size is an even number of inches shank 38 is then inserted through the same numbered pin aperture 26 of the other stretcher arm 12*b* and securing nut 34 secured onto threaded end 36. If the desired waistband size is an odd number of inches, shank 38 is then inserted through a pin aperture 26 of the other stretcher arm 12*b* having a numeral corresponding to the desired waistband size plus one and securing nut 34 secured onto threaded end 36. Once pivot pin assembly 14 is installed, waistband clips 22 of a stretcher arms 12*a* and 12*b* are clipped onto waistband 46. The user then inserts a finger through each finger loop member 28 and forces stretcher arms 12*a* and 12*b* into a substantially parallel position with respect to each other. Locking pin 16 is then inserted through two aligned pin apertures 26 of stretcher arms 12*a* and 12*b*. Garment waistband stretcher 10 is removed from garment 48 by simply reversing the attachment procedure.

It can be seen from the preceding description that a garment waistband stretcher has been provided that is securable to the waistband of a garment, that includes a mechanism for preventing stretching of the garment waistband past a predetermined size; and that is inexpensive and easy to manufacture and use.

It is noted that the embodiment of the garment waistband stretcher described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A garment waistband stretcher comprising:

a first elongated stretching arm having a first expanded end member that includes a first waistband contact surface and a first resilient waistband clip secured adjacent to said first expanded end having a first distal end portion that is directed away from said first waistband contact surface, said first stretching arm having a first plurality of pin receiving apertures formed entirely therethrough and spaced along the length thereof at equal intervals;

a second elongated stretching arm having a second expanded end member that includes a second waistband contact surface and a second resilient waistband clip secured adjacent to said second expanded end having a second distal end portion that is directed away from said second waistband contact surface, said second stretching arm having a second plurality of pin receiving apertures formed entirely through said second stretcher arm and spaced along the length thereof at equal intervals, said first and second elongated stretching arms being placed adjacent to each other with at least two of said first pin apertures in registration with at least two of said second pin apertures;

a pivot pin assembly including a pivot pin having a shaft passing sequentially through one of said first pin apertures and one of said second pin apertures; and a locking pin having a shaft passing sequentially through one of said first pin apertures and one of said second pin apertures.

2. The garment waistband stretcher of claim 1, wherein:

said pivot pin has a threaded end, a shank snugly passing through said first and second pin apertures, and a shank cap secured to a non-threaded end of said shank sized sufficient to prevent passage of said shank cap through said first and second pin apertures; and a securing nut companionately threaded to engage and secure said threaded end of said shank.

3. The garment waistband stretcher of claim 1, wherein:

said first stretcher arm includes a first closed perimeter finger loop at a first far end of said first stretcher arm opposite said waistband clip: and said second stretcher arm includes a second finger closed perimeter loop at a second far end of said second stretcher arm opposite said second waistband clip.

4. The garment waistband stretcher of claim 3, wherein:

said pivot pin has a threaded end, a shank snugly passing through said first and second pin apertures, and a shank cap secured to a non-threaded end of said shank sized sufficient to prevent passage of said shank cap through said first and second pin apertures; and a securing nut companionately threaded to engage and secure said threaded end of said shank.

* * * * *